US005525096A

United States Patent [19]

Mayahara et al.

[11] Patent Number: 5,525,096

[45] Date of Patent: Jun. 11, 1996

[54] APPARATUS FOR GRINDING SPHERICAL SURFACE

[75] Inventors: Kiyoshi Mayahara; Mamoru Inoue, both of Osaka-fu; Keniti Matumura, Hyogo-ken, all of Japan

[73] Assignee: Matsushita Electric Industrial Co., Ltd., Japan

[21] Appl. No.: 202,125

[22] Filed: Feb. 25, 1994

Related U.S. Application Data

[63] Continuation-in-part of Ser. No. 128,207, Sep. 29, 1993, abandoned.

[51] Int. Cl.[6] ..... B24B 13/00

[52] U.S. Cl. ..... 451/292; 451/401; 451/277

[58] Field of Search ..... 451/42, 332, 331, 451/277, 292, 401

[56] References Cited

U.S. PATENT DOCUMENTS

| | | | |
|---|---|---|---|
| 3,665,648 | 5/1972 | Yamanaka | 451/292 |
| 4,829,716 | 5/1989 | Ueda et al. | 451/292 |

FOREIGN PATENT DOCUMENTS

| | | | |
|---|---|---|---|
| 51-37877 | 10/1980 | Japan | 451/292 |
| 0751572 | 7/1980 | U.S.S.R. | 451/292 |

*Primary Examiner* Robert A. Rose
*Attorney, Agent, or Firm* Wenderoth, Lind & Ponack

[57] ABSTRACT

An apparatus for grinding spherical surfaces of workpieces includes a grinding section having a grindstone rotating mechanism for rotating around an axis of a shaft thereof with a grindstone held at an end of the shaft, a feeding mechanism for feeding the grindstone rotating mechanism toward the workpiece in a direction along the shaft, and a fixing mechanism for holding the grindstone rotating mechanism and the feeding mechanism and determining an angle 1 inclination of the short of the grindstone rotating mechanism with respect to the workpiece. A plurality of workpiece holding mechanisms are provided for holding the workpieces at ends of shafts thereof, the workpiece held by at least one of the workpiece holding mechanisms being opposed to the grindstone. A workpiece rotating mechanism is provided for rotating the workpiece holding mechanism which holds the workpiece opposed to the grindstone. A workpiece positioning section is provided for holding the workpiece holding mechanisms and being rotated and stopped so that an unground workpiece held by at least one of the workpiece holding mechanisms is placed at a workpiece replacing position when a ground workpiece held by the other of the workpiece holding mechanisms has been placed at a grinding position of the grindstone rotating mechanism.

3 Claims, 7 Drawing Sheets

APPARATUS FOR GRINDING SPHERICAL SURFACE

This is a continuation-in-part of U.S. Ser. No. 08/128,207 filed Sep. 29, 1993 and now abandoned.

BACKGROUND OF THE INVENTION

The present invention relates to a method and an apparatus for grinding the spherical surface of an optical lens or that of a mirror.

In recent years, optical technique has been utilized more and more in various industrial fields. Consequently, there is a growing demand for optical lenses and thus, the development of an apparatus for grinding a lens having high productivity.

The construction of a conventional apparatus of this kind is described below with reference to FIG. 9.

The apparatus comprises a grindstone rotating mechanism having a grindstone 50 for grinding and a grindstone rotating spindle 51 which rotates at a high speed of 20,000 rpm to 40,000 rpm with the grindstone 50 held at the lower end of the spindle 51; a feeding mechanism 57 for feeding the workpiece rotating mechanism toward the grindstone 50 along the rotary shaft of the spindle 51; a slide mechanism having a slide table 55 holding the grindstone rotating mechanism and the feeding mechanism and moving the grindstone rotating mechanism at a right angle to the direction in which the rotary shaft of the spindle 51 extends, thereby bringing the grindstone 50 into contact with a workpiece 56 at a predetermined position thereof and a servo-motor 58 for moving the slide table 55; a rotary base 52 holding the slide mechanism and being rotatable about a shaft 54 by a gear 53, for fixing the axial direction of the spindle 51 at a predetermined inclination; a collet chuck 59 for holding the workpiece 56 at an end of the shaft thereof confronting the grindstone 50; a motor for rotating the collet chuck 59; and an automatic loader 61 for supplying the workpiece 56 to the collet chuck 59 and removing therefrom.

The operation of the above-described apparatus is described below with reference to FIG. 9.

After the grindstone rotating mechanism is moved to a position at which the grindstone rotating mechanism does not interfere with the automatic loader 61, the ground workpiece 56 is removed from the collet chuck 59 by the automatic loader 61. Then, the unground workpiece 56 is supplied to the collet chuck 59. The inclination of the spindle 51 of the grindstone rotating mechanism is set to a predetermined angle by the rotary base 52 based on the spherical configuration of the workpiece 56. Then, the grindstone 50 is moved toward the workpiece 56 by the slide mechanism until the grindstone 50 reaches at a predetermined position. The workpiece 56 is rotated at a low speed by the motor 60 so as to feed the grindstone 50 rotating at a high speed toward the workpiece 56 by means of the feeding mechanism 57 driven by the servomotor 58 controlled by an NC apparatus. In this manner, the grinding of the workpiece 56 is completed with a predetermined rotation symmetry. Then, the grindstone rotating mechanism is moved away from the automatic loader 61 so that the grindstone rotating mechanism does not interfere with the automatic loader 61.

The construction of the above-described apparatus has the following disadvantage. That is, each time the grinding of the workpiece 56 terminates, the ground workpiece 56 is removed from the collet chuck 59 by the automatic loader 61 and the unground workpiece 56 is supplied thereto by the automatic loader 61. Accordingly, the grinding operation of the apparatus has to be stopped and in addition, the grindstone rotating mechanism must be moved upward by a great distance so that the grindstone rotating mechanism does not interfere with the automatic loader 61 while the workpieces 56 are being replaced with each other. Thus, it takes long for even a skilled operator to grind the workpiece 56 and thus the apparatus has a low productivity.

SUMMARY OF THE INVENTION

It is an object of the present invention to provide a method and a compact apparatus capable of performing grinding operations at high speed and having high productivity.

In accomplishing these and other objects, according to a first aspect of the present invention, there is provided an apparatus for grinding spherical surfaces of workpieces, comprising: a grinding section having a grindstone rotating mechanism for rotating around an axis of a shaft thereof with a grindstone held at an end of the shaft, a feeding mechanism for feeding the grindstone rotating mechanism toward the workpiece along the shaft, and a fixing mechanism for holding the grindstone rotating mechanism and the feeding mechanism and determining an axial direction of the grindstone rotating mechanism by being inclined at an appropriate angle with respect to the workpiece in conformity to a grinding position of the grindstone; a plurality of workpiece holding mechanisms for holding the workpieces at ends of shafts thereof, the workpiece held by at least one of the workpiece holding mechanisms being opposed to the grindstone; a workpiece rotating mechanism for rotating the workpiece holding mechanism which holds the workpiece opposed to the grindstone; and a workpiece positioning section for holding the workpiece holding mechanisms and being rotated and stopped so that an unground workpiece held by at least one of the workpiece holding mechanisms is placed at a workpiece replacing position when a ground workpiece held by the other of the workpiece holding mechanisms has been placed at a grinding position of the grindstone rotating mechanism.

According to a second aspect of the present invention, there is provided a method for grinding spherical surfaces of workpieces, comprising the steps of: holding the workpieces at ends of shafts of a plurality of workpiece holding mechanisms, the workpiece held by at least one of the workpiece holding mechanisms being opposed to a grindstone; grinding the workpiece by rotating the workpiece holding mechanism which holds the workpiece opposed to the grindstone by a workpiece rotating mechanism, rotating around an axis of a shaft of a grindstone rotating mechanism with the grindstone held at an end of the shaft, feeding the grindstone rotating mechanism toward the grindstone along the direction of the shaft by operating a feeding mechanism, and holding the grindstone rotating mechanism and the feeding mechanism and determining an angle of inclination of the grindstone shaft of the rotating mechanism with respect to the workpiece in conformity to a grinding position of the grindstone; and rotating and stopping the workpiece positioning section so that an unground workpiece held by at least one of the workpiece holding mechanisms is placed at a workpiece replacing position when a ground workpiece held by the other of the workpiece holding mechanisms has been placed at a grinding position of the grindstone rotating mechanism.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
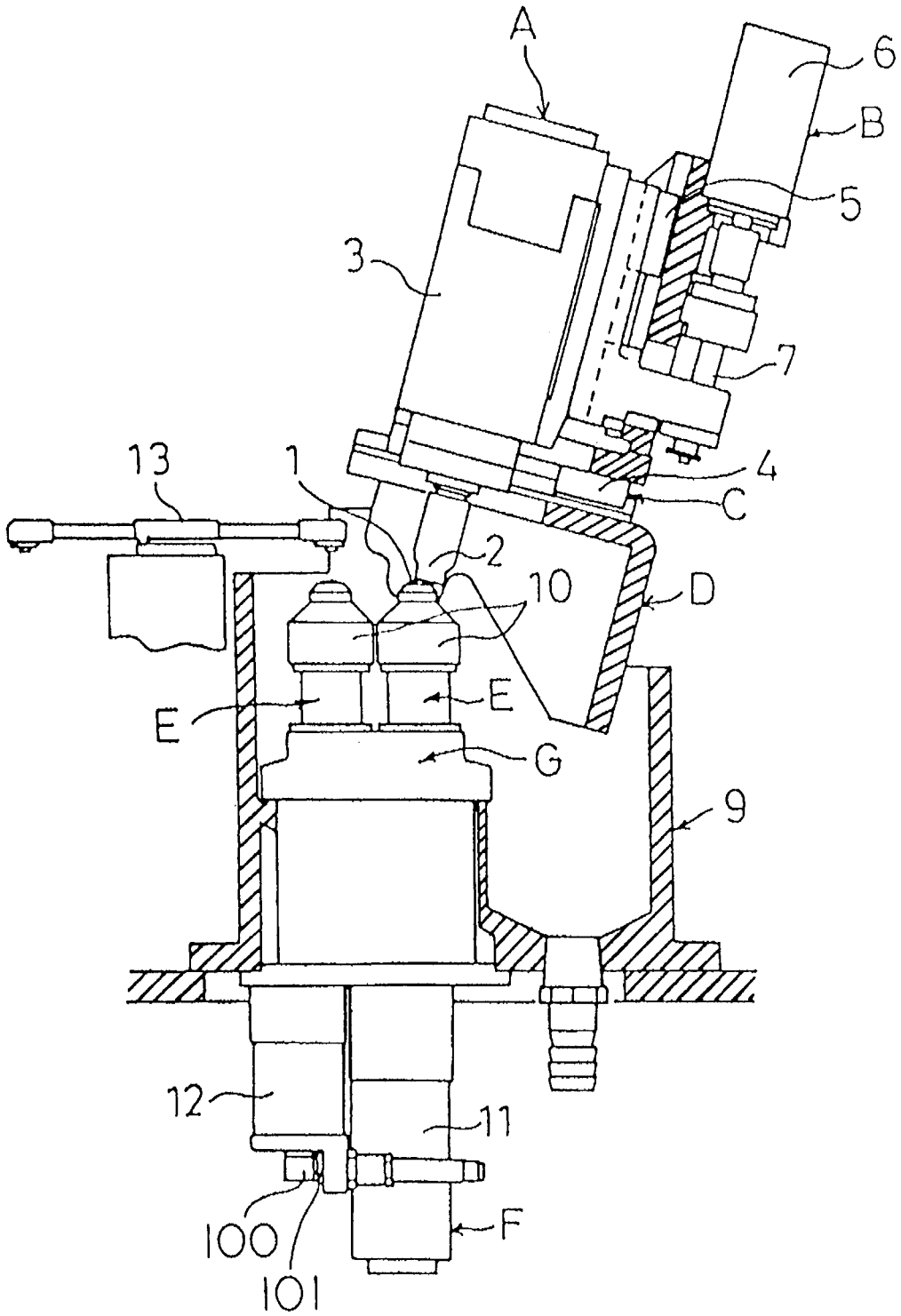
FIG. 1 is a side view showing an apparatus for grinding the spherical surface of a workpiece such as an optical lens, a mirror, or the like according to an embodiment of the present invention.

Before the description of the present invention proceeds, it is to be noted that like parts are designated by like reference numerals throughout the accompanying drawings.

The construction and operation of an apparatus for grinding spherical surfaces according to an embodiment of the present invention is described below with reference to FIGS. 1 through 4.

Referring to FIG. 1, the apparatus comprises: a grinding section having a grindstone rotating mechanism (A), a feeding mechanism (B), a lateral moving mechanism (C), and a fixing mechanism (D); two workpiece holding mechanisms (E); a workpiece rotating mechanism (F); and a workpiece positioning section (G). The grindstone rotating mechanism (A) has a grindstone rotating spindle 3 which rotates at a high speed of 20,000 rpm through 40,000 rpm with a grindstone 2 held at the lower end of the rotary shaft of the spindle 3. The feeding mechanism (B) has a driving motor 6, a feed screw 7, and a table 5 holding the grindstone rotating mechanism (A) and feeding the grindstone rotating mechanism (A) toward one of the workpiece holding mechanisms (E) along the direction of the rotary shaft of the spindle 3. The lateral moving mechanism (C) has a table 4 holding the feeding mechanism (B) and being laterally movable, thereby allowing the lower end of the cup-shaped grindstone 2 to contact the rotational center of the workpiece 1. The diameter of the lower end of the cup-shaped grindstone 2 is in agreement with the radius of the workpiece 1. The fixing mechanism (D) is installed on a main body frame 9 and holds the grindstone rotating mechanism (A), the feeding mechanism (B), and the lateral moving mechanism (C) and rotates, thus determining the axial direction of the spindle 3 by inclining the spindle 3 at an appropriate angle with respect to the workpiece 1, in conformity to the grinding position of the grindstone 2. Each of the two workpiece holding mechanisms (E) has a workpiece holding member 10 which rotates about the axis thereof by holding the workpiece 1 at the upper end of the shaft thereof opposed to the grindstone 2. The workpiece rotating mechanism (F) has a motor 11 for rotating the workpiece holding mechanisms (E) around its axis. The workpiece positioning section (G) holds the two workpiece holding mechanisms (E) and is rotated and stopped by a rotary actuator 12, thus placing the unground workpiece 1 held by one of the workpiece holding mechanisms (E) at a workpiece replacing position when the ground workpiece 1 held by the other workpiece holding mechanism (E) has been disposed at a grinding position of the grindstone rotating mechanism (A). An automatic loader 13 uses suction to supply the workpiece 1 to the workpiece holding member 10 and for removing the workpiece 1 therefrom.

Figure 2:
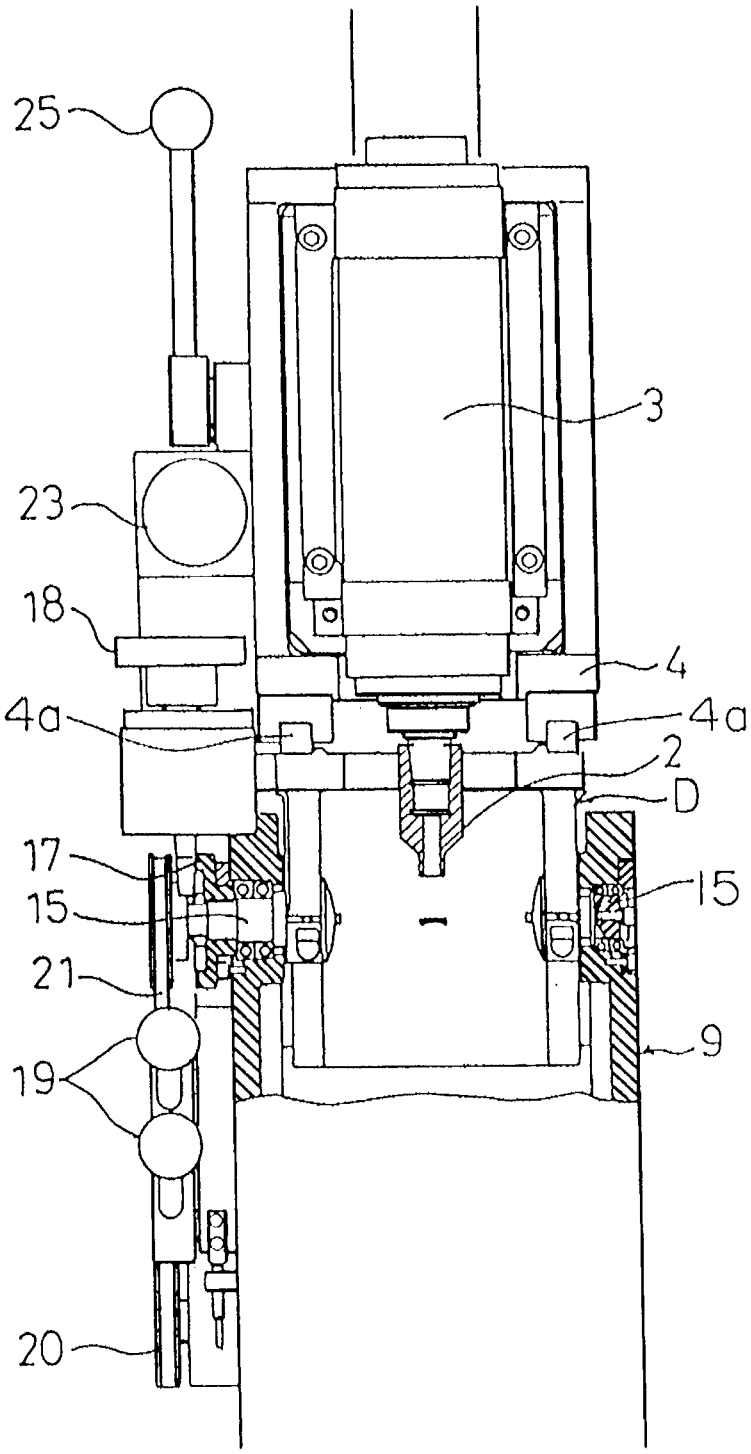
FIG. 2 is a partially enlarged sectional front view showing the apparatus of FIG. 1.
Figure 3:
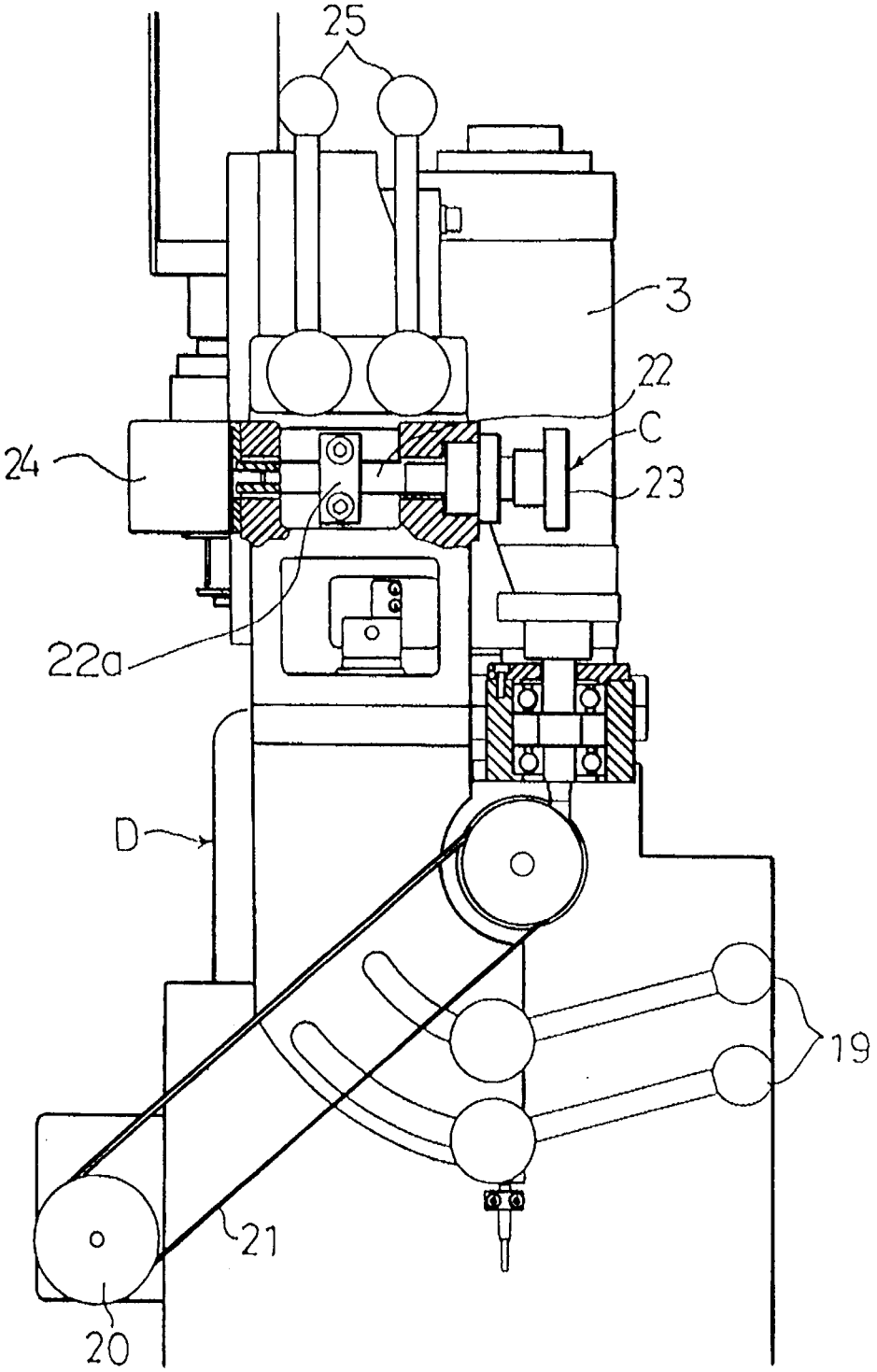
FIG. 3 is a partially enlarged side view showing the apparatus of FIG. 1.

FIGS. 2 and 3 show the details of the fixing mechanism (D) for setting the grindstone 2 held by the grindstone rotating mechanism (A) at an inclined posture in conformity to the spherical configuration of the workpiece 1.

Referring to FIGS. 2 and 3, the fixing mechanism (D) is rotatably and fixably supported on the main body frame 9 by the rotary shaft 15. By rotating the handle 18, the rotational force of the handle 18 is transmitted to the rotary shaft 15 via a bevel gear 17, thus rotating the fixing mechanism (D). When the fixing mechanism (D) is inclined at an appropriate angle, locking levers 19 are operated to fix the fixing mechanism (D) at the angle. The rotational force of the rotary shaft 15 is transmitted to an encoder 20 via a belt 21. Then, the inclination of the fixing mechanism (D) can be detected by the encoder 20. When a handle 23 of the lateral moving mechanism (C) is rotated, a feed screw 22 is rotated to move a nut 22*a* fixed to the table 4 with the table 4 guided by guide rails 4*a*, thus moving the lateral moving mechanism (C). As a result, an encoder 24 connected with the feed screw 22 detects the movement amount of the lateral moving mechanism (C). When the lateral moving mechanism (C) has reached a predetermined position, the lateral moving mechanism (C) is fixed at the predetermined position by locking levers 25.

Figure 4:
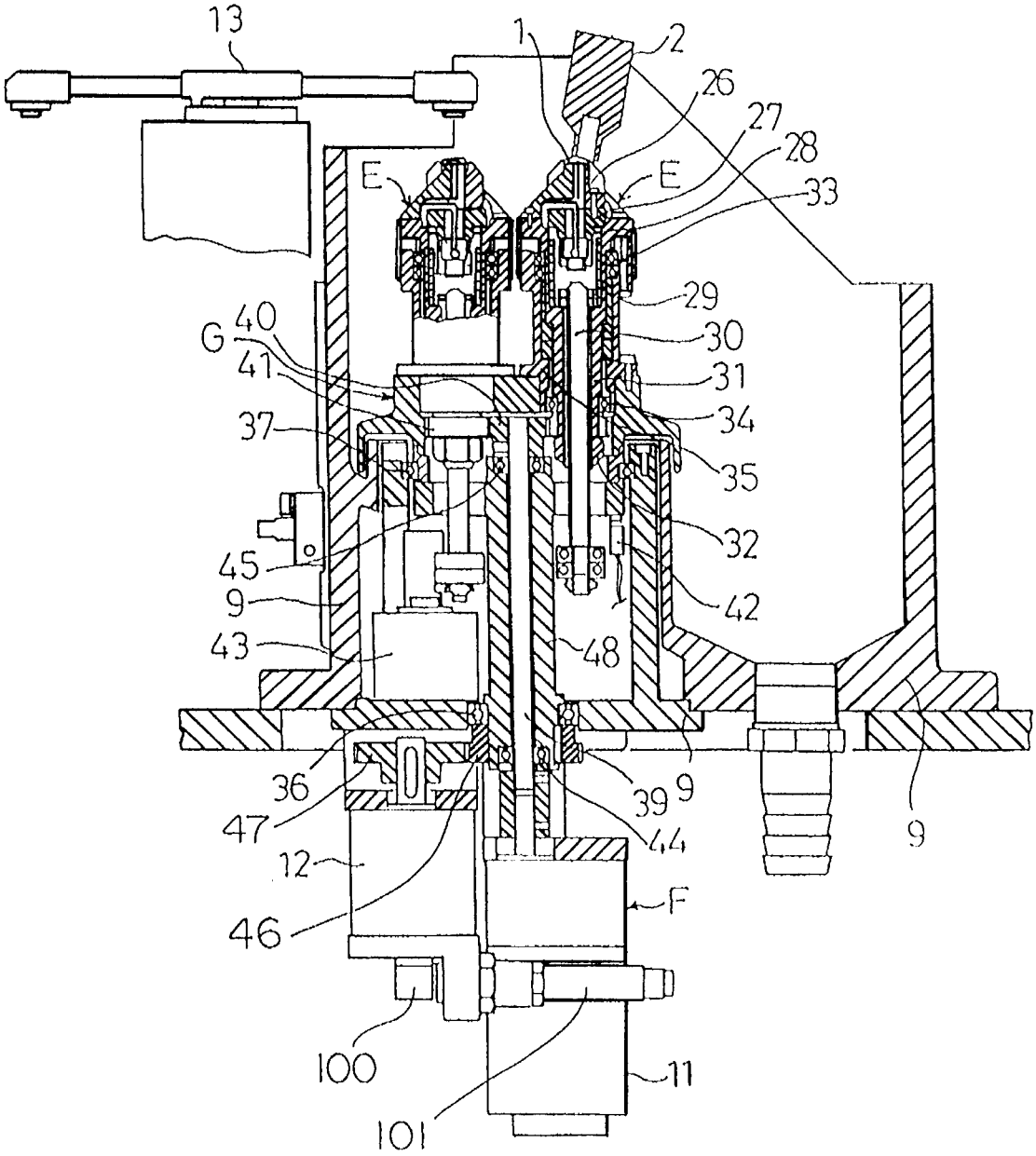
FIG. 4 is a sectional side view showing the apparatus of FIG. 1.
Figure 7:
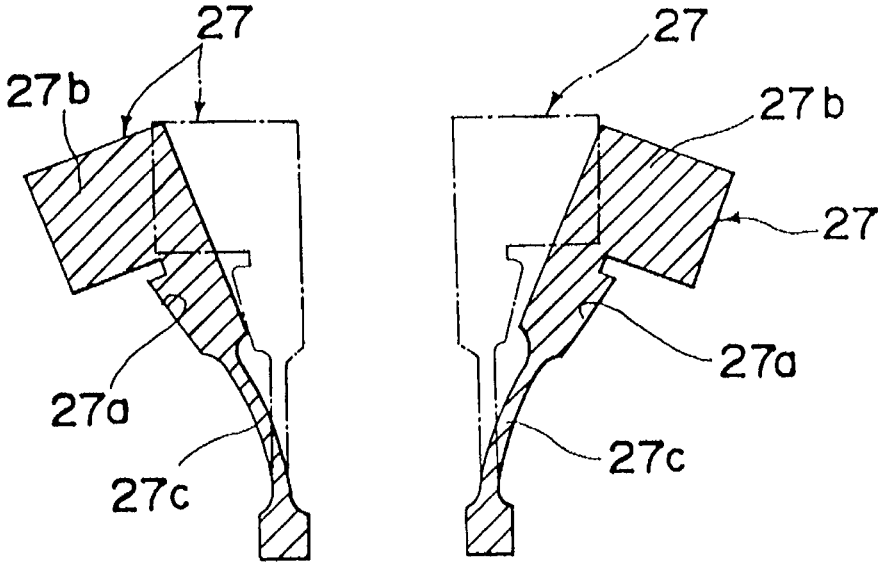
FIG. 7 is a sectional side view showing collet chucks in FIG. 1.
Figure 6:
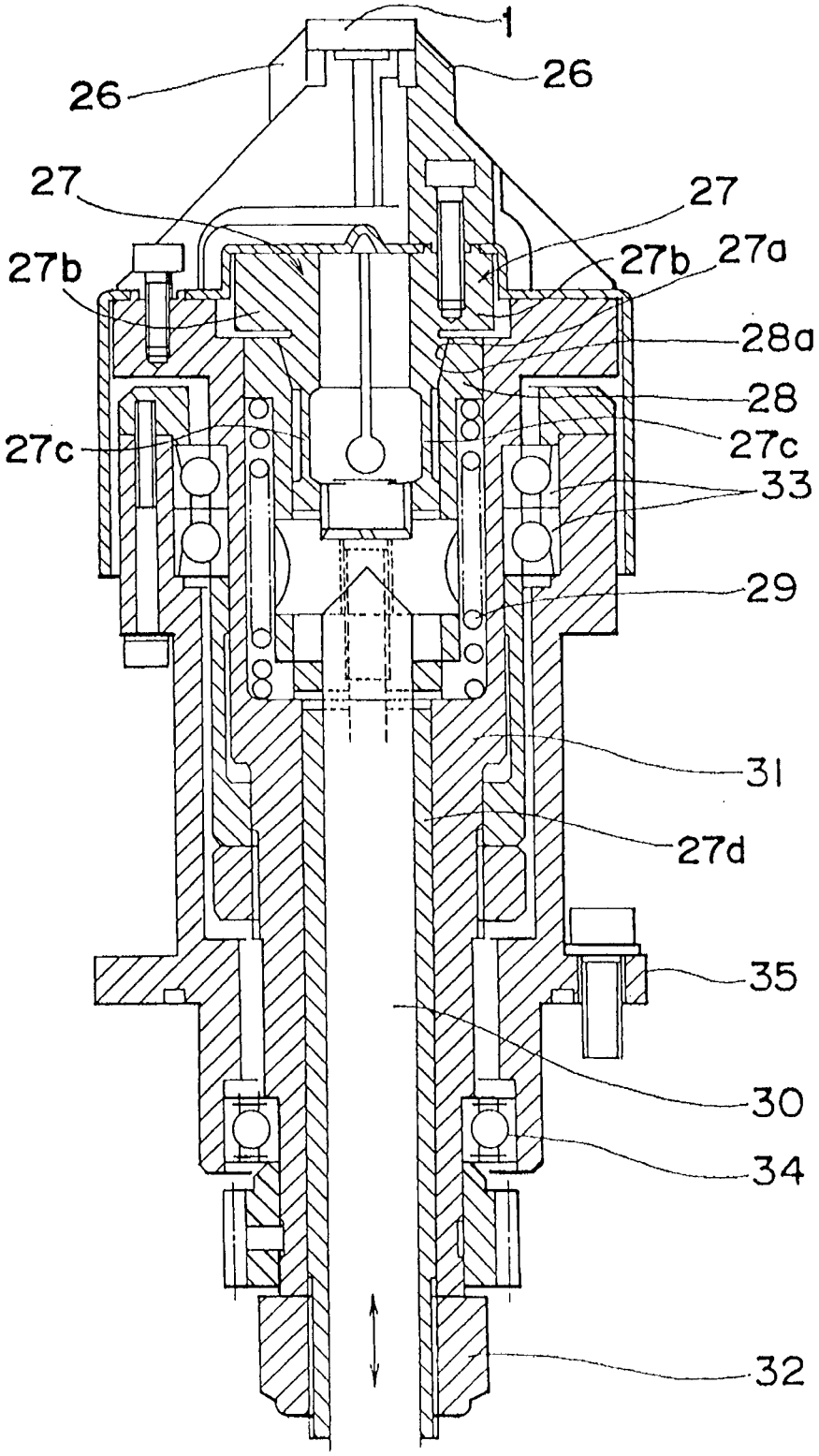
FIG. 6 is a sectional side view showing the apparatus of FIG. 4.
Figure 9:
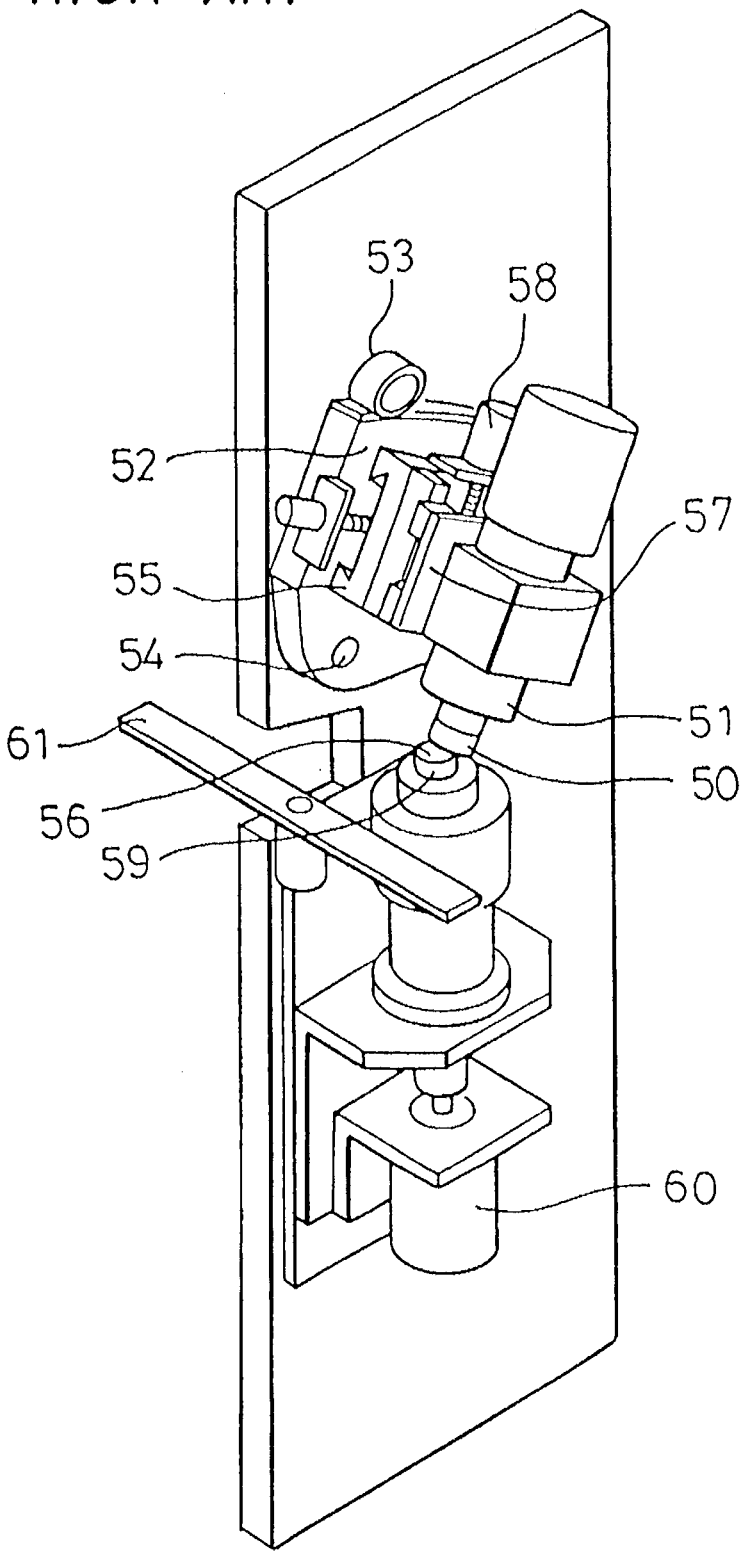
Fig. 9 PRIOR ART
FIG. 9 is a perspective view showing a conventional grinding apparatus.

Referring to FIGS. 4, 6, and 7, the detailed construction of the workpiece holding mechanism (E), the workpiece rotating mechanism (F), and the workpiece positioning section (G) is described below.

As shown in FIGS. 4 and 6, the workpiece holding mechanism (E) comprises a collet chuck having collet chuck parts 27, a tapered member 28, a spring 29, a sliding shaft 30, and a collet opening and closing cylinder 43. The collet chuck parts 27 have claws 26 for holding the workpiece 1. As shown in FIG. 7, each of the collet chuck parts 27 has a claw-supporting portion 27*b* for supporting the claw 26 at the upper portion, a tapered portion 27*a* at the outer surface of the middle portion, and a thin portion 27*c* at the lower portion thereof so that the claw-supporting portion 27*b* and the tapered portion 27*a* can be bent outwardly and easily as shown by solid lines and chain lines in FIG. 7. The tapered member 28 has a tapered surface 28*a* formed at the inside thereof to slide and contact the tapered portions 27*a* of the collet chuck parts 27 by the movement of the tapered member 28. Then, the tapered member 28 moves upwardly toward the large-diameter portion of the tapered portions 27*a* of the collet chuck parts 27 to press against the collet chuck parts 27 in engagement with the tapered portion 27*a* of the collet chuck parts 27, thus closing the collet chuck parts 27, and moves downwardly toward the small-diameter portion of each tapered portion 27*a* in disengaged relation therewith, thus opening the collet chuck parts 27. The spring 29 presses the tapered member 28 upwardly toward the large-diameter portion of each tapered portion 27*a* to close the collet chuck parts 27. The sliding shaft 30 has the tapered member 28 installed on the upper end thereof and penetrates coaxially through a cylindrical shaft 31 of the workpiece holding mechanisms (E) and slidably supported on the shaft 31 in the axial direction thereof. The collet opening and closing cylinder 43 is disposed at the workpiece replacing position and engages the sliding shaft 30 at this position, thus sliding the sliding shaft 30 toward the small-diameter portions of the tapered portions 27*a* of the collet chuck parts 27 and opening the collet chuck. A lower cylindrical portion 27*d* of the collet chuck is fixed to the shaft 31 of the workpiece rotating mechanism (F) by a nut 32. The shaft 31 rotatably supported on a housing 35 of the workpiece positioning section (G) by bearings 33 and 34 is rotated around its axis by the workpiece rotating mechanism (F) which will be described later.

Figure 5:
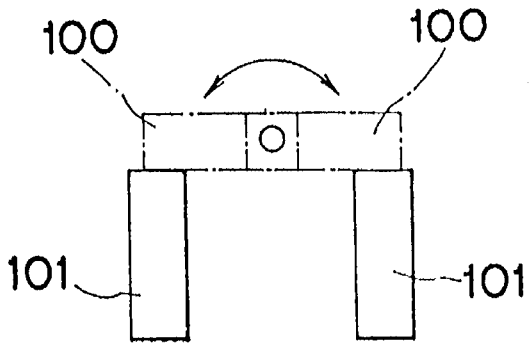
FIG. 5 is a bottom view showing the positioning operation of a workpiece positioning section (G) in FIG. 1.

The workpiece positioning section (G) holding the two workpiece holding mechanisms (E) is rotatably supported on the main body frame 9 by bearings 36 and 37 and rotated and stopped by the rotary actuator 12 via gears 46 and 47, thus placing the workpiece 1 held by one of the workpiece holding mechanisms (E) at the workpiece replacing position when the workpiece 1 held by the other workpiece holding mechanism (E) has been placed at the grinding position of the grinding section. This positioning operation can be performed by contacting an arm 100 fixed to a rotary shaft of the rotary actuator 12 with any one of stoppers 101 as shown in FIG. 5. The workpiece positioning section (G) has a hollow shaft 48 extending through the axis thereof. A driving shaft 39 of the workpiece rotating mechanism (F) rotatably supported by bearings 44 and 45 penetrates through the hollow shaft 48. In this construction, the workpiece positioning section (G) and the workpiece rotating mechanism (F) have a construction in common spatially, and in addition, have the driving portion (shaft 39) in common. Accordingly, the apparatus is compact and inexpensive and has high rotational accuracy.

The driving shaft 39 of the workpiece rotating mechanism (F) is connected with the motor 11 and rotates while supported by the bearings 44 and 45. The workpiece rotating mechanism (F) rotates the workpiece holding mechanism (E) via gears 40 and 41 serving as a rotational force-transmitting device.

A sensor 42 such as a magnetic sensor discriminates which of the workpiece holding mechanisms (E) is placed at the grinding position. When one of the workpiece holding mechanisms (E) holds the workpiece 1, the position of the grindstone 2 varies with respect to the workpiece 1 depending on the processing accuracy of components constituting the workpiece holding mechanisms (E). Therefore, if the grindstone 2 is fed toward the workpiece 1 by the same distance for all workpieces 1, there will be variations in the finish thereof. The sensor 42 is provided to discriminate which of the workpiece holding mechanisms (E) is placed at the grinding position. The grinding condition, e.g., the feeding amount of the grindstone 2 can be adjusted depending on the workpiece holding mechanism (E), placed at the grinding position, detected by the sensor 42.

The operation of the apparatus according to this embodiment is described below with reference to FIGS. 1 through 4.

Figure 8:
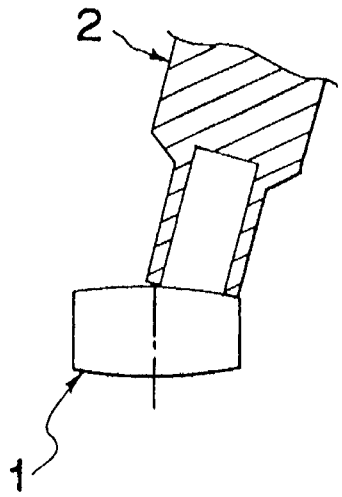
FIG. 8 is a view showing the state of grinding the spherical surface of the workpiece.

The handle 18 is rotated according to the spherical configuration of the workpiece 1 to rotate the fixing mechanism (D). When the fixing mechanism (D) has made a predetermined inclination, the fixing mechanism (D) is fixed by the locking levers 19. Then, the handle 23 is rotated to move the lateral moving mechanism (C) to feed the grindstone 2 toward the workpiece 1 so that the lower end of the grindstone 2 contacts the rotational center of the workpiece 1 as shown in FIG. 8. Then, the lateral moving mechanism (C) is fixed at the predetermined position by the locking levers 25.

Then, the spindle 3 is rotated at a high speed and the grindstone 2 is fed by the feeding mechanism (B) toward the workpiece 1 rotating at a low speed by the motor 11. At this time, depending on the workpiece holding mechanism (E) discriminated by the sensor 42, the grindstone 2 is fed to a predetermined position at a predetermined speed according to a condition suitable for the discriminated workpiece holding mechanism (E). The workpiece 1 remains held at the predetermined position for a predetermined period of time to grind the surface of the workpiece 1 into a configuration having rotational symmetry.

Thereafter, the grindstone 2 is moved away a slight distance from the workpiece 2 so that the grindstone 2 and the workpiece 1 do not interfere with each other when the workpiece positioning section (G) rotates.

Then, the workpiece 1 placed at the workpiece replacing position is handled as follows: The collet opening and closing cylinder 43 engages the sliding shaft 30, thus pulling the sliding shaft 30 toward the small-diameter portion of the tapered portion 28*a* of the tapered member 28 and then opening the collet chuck parts 27 so that the ground workpiece 1 can be replaced with the unground workpiece 1. Then, the automatic loader 13 uses suction to remove the ground workpiece 1 from the collet chuck parts 27 of the workpiece holding mechanisms (E) and supply the unpolished workpiece 1 to the collet chuck parts 27.

The above-described operation has the following two features: One feature is that while the workpiece 1 held by one of the workpiece holding mechanisms (E) and placed at the grinding position is being ground, the ground workpiece 1 held by the other workpiece holding mechanism (E) can be replaced with the unground workpiece 1. The other feature is that since the grindstone rotating mechanism (A) is placed at a position at which the grindstone rotating mechanism (A) does not interfere with the workpiece replacing operation being performed at the workpiece replacing position, it is unnecessary to move the grindstone rotating mechanism (A) a long distance from the workpiece replacing position. Therefore, when the grindstone 2 has moved away from the workpiece 1 upon termination of grinding operation, the workpiece positioning section (G) can be rotated. Thus, the grinding operation can be accomplished in a short period of time and with high productivity.

According to the above construction, the workpiece positioning section (G) and the workpiece rotating mechanism (F) have a construction in common spatially, and in addition, have the driving portion in common. Accordingly, the apparatus is compact and inexpensive and has high rotational accuracy.

The workpiece holding mechanisms (E) are different from each other with respect to grinding performance. Therefore, it is necessary to grind workpieces 1 under different conditions depending on the workpiece holding mechanism (E), based on the discrimination made by the sensor 42. In this manner, variations in finished workpieces can be reduced and then workpieces 1 can be ground with almost the same precision.

The collet chuck parts 27, of the workpiece holding mechanism (E), positioned at the workpiece replacing position release the ground workpiece 1 from the grinding position, thus easily replacing the ground workpiece 1 with the unground workpiece.

It is possible to manually rotate the workpiece positioning section (G) without the rotary actuator 12.

Although the present invention has been fully described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims unless they depart therefrom.

What is claimed is:

1. An apparatus for polishing spherical surfaces of workpieces, comprising:

a plurality of workpiece holding mechanisms having shafts for holding the workpieces at ends thereof;

a polishing section having a grindstone rotating mechanism having a rotation shaft for holding a grindstone opposite one of said workpiece holding mechanisms, and for rotating the grindstone around an axis of said rotation shaft, a feeding mechanism for feeding said grindstone rotating mechanism in a direction along said rotation shaft toward said one of said workpiece holding mechanisms, and a fixing mechanism for holding said grindstone rotating mechanism add said feeding mechanism and determining an angle of inclination of said rotation shaft of said grindstone rotating mechanism with respect to said one of said workpiece holding mechanisms;

a workpiece rotating mechanism for rotating said one of said workpiece holding mechanisms:

a workpiece positioning section for holding and rotatably repositioning said workpiece holding mechanisms so that an unpolished workpiece held by at least one of said workpiece holding mechanisms is placed at a workpiece replacing position when a polished workpiece held by the other of said workpiece holding mechanisms is placed at a polishing position opposite said grindstone rotating mechanism;

wherein said workpiece positioning section has a hollow shaft extending through an axis thereof; and wherein said workpiece rotating mechanism comprises a driving shaft coaxially penetrating through said hollow shaft of said workpiece positioning section and rotatably supported by said hollow shaft, a motor for rotating said driving shaft, and a rotational force transmitting device for transmitting rotational force of said driving shaft to each of said workpiece holding mechanisms so as to rotate each of said workpiece holding mechanisms.

2. An apparatus for polishing spherical surfaces of workpieces, comprising:

a plurality of workpiece holding mechanisms having shafts for holding the workpieces at ends thereof;

a polishing section having a grindstone rotating mechanism having a rotation shaft for holding a grindstone opposite one of said workpiece holding mechanisms, and for rotating the grindstone around an axis of said rotation shaft, a feeding mechanism for feeding said grindstone rotating mechanism in a direction along said rotation shaft toward said one of said workpiece holding mechanisms, and a fixing mechanism for holding said grindstone rotating mechanism and said feeding mechanism and determining an angle of inclination of said rotation shaft of said grindstone rotating Mechanism with respect to said one of said workpiece holding mechanisms;

a workpiece rotating mechanism for rotating said one of said workpiece holding mechanisms;

a workpiece positioning section for holding and rotatably repositioning said workpiece holding mechanisms so that an unpolished workpiece held by at least one Of said workpiece holding mechanisms is placed at a workpiece replacing position when a polished workpiece held by the other of said workpiece holding mechanisms is placed at a polishing position opposite said grindstone rotating mechanism; and a device for discriminating which of said workpiece holding mechanisms is placed at the polishing position.

3. An apparatus for polishing spherical surfaces of workpieces comprising:

a plurality of workpiece holding mechanisms having shafts for holding the workpieces at ends thereof;

a polishing section having a grindstone rotating mechanism having a rotation shaft for holding a grindstone opposite one of said workpiece holding mechanisms, and for rotating the grindstone around an axis of said rotation shaft, a feeding mechanism for feeding said grindstone rotating mechanism in a direction along said rotation shaft toward said one of said workpiece holding mechanisms, and a fixing mechanism for holding said grindstone rotating mechanism and said feeding mechanism and determining an angle of inclination of said rotation shaft of said grindstone rotating mechanism with respect to said one of said workpiece holding mechanisms;

a workpiece rotating mechanism for rotating said one of said workpiece holding mechanisms;

a workpiece positioning section for holding and rotatably repositioning said workpiece holding mechanisms so that an unpolished workpiece held by at least one of said workpiece holding mechanisms is placed at a workpiece replacing position when a polished workpiece held By the other of said workpiece holding mechanisms is placed at a polishing position opposite said grindstone rotating mechanism; and wherein each of said workpiece holding mechanisms comprises a collet chuck having collet chuck parts with tapered portions such that said collet chuck includes a large-diameter portion and a small-diameter portion, a tapered member for moving toward said large-diameter portion of said collet chuck and being pressed against said collet chuck parts by engagement with said tapered portions of said collet chuck parts to close said collet chuck, and moving toward said small-diameter portion of said collet chuck in disengaged relation therewith to open said collet chuck, a sliding shaft having said tapered member installed on an end thereof, said sliding shaft penetrating coaxially through said shaft of the respective workpiece holding mechanism and being axially slidably supported by said shaft of the respective workpiece holding mechanism, and a collet opening and closing device, disposed at the workpiece replacing position, for engaging said sliding shaft at the workpiece replacing position to alternatively slide said sliding shaft toward said large-diameter portion of said collet chuck and said small-diameter portion of said collet chuck to close and open said collet chuck.

* * * * *